United States Patent [19]

Davis

[11] 3,960,193

[45] June 1, 1976

[54] WEIGHTED PICNIC TABLE CLOTH

[76] Inventor: Lyle W. Davis, P.O. Box 347, Kerrville, Tex. 78028

[22] Filed: Mar. 10, 1975

[21] Appl. No.: 556,863

[52] U.S. Cl. ..... 150/52 R

[51] Int. Cl.[2] ..... A47B 97/00

[58] Field of Search ..... 150/52 R, 52 K; 5/334 R, 344

[56] References Cited

UNITED STATES PATENTS

| | | | |
|---|---|---|---|
| 429,894 | 6/1890 | Doremus | 5/334 R |
| 2,639,751 | 5/1953 | Flaherty | 150/52 K |
| 2,728,165 | 12/1955 | Runyon | 150/52 R |
| 2,994,356 | 8/1961 | Fleming | 150/52 K |
| 3,226,737 | 1/1966 | Rote | 5/344 |
| 3,310,091 | 3/1967 | Geisen | 150/52 R |

FOREIGN PATENTS OR APPLICATIONS

| | | | |
|---|---|---|---|
| 928,869 | 6/1963 | United Kingdom | 150/52 K |

*Primary Examiner*—Donald F. Norton
*Attorney, Agent, or Firm*—Clarence A. O'Brien; Harvey B. Jacobson

[57] ABSTRACT

A generally rectangular flexible panel is provided including opposite longitudinal side and end marginal edge portions. The opposite side marginal edge portions are provided with hems and weight members are disposed in the opposite end of each side marginal edge portion hem. Each hem is closed, as by sewing, on opposite sides of each weight member and each weight member includes a closed flexible tubular body having fluent weight material disposed therein.

1 Claim, 5 Drawing Figures

WEIGHTED PICNIC TABLE CLOTH

BACKGROUND OF THE INVENTION

There are many instances wherein a table cloth tends to be shifted relative to a tabletop over which the table cloth is draped and the depending marginal edge portions of the table cloth tend to be displaced to the extent that shifting of the table cloth relative to the table occurs.

A table cloth may be shifted relative to the tabletop over which it is draped by frictional contact of a person moving along one side edge of the table over which the table cloth is draped with the result that the table cloth may become disarranged or portions thereof disposed over the tabletop may be displaced to the extent that articles disposed on the tabletop are upset. Further, when a table cloth is draped over a table used outside, wind often has a tendency to be trapped beneath and lift those portions of the table cloth which depend downwardly from corresponding marginal edge portions of the table over which the table cloth is draped.

Heretofore, various means have been devised for assisting in maintaining a table cloth in position on a table over which the table cloth is draped. Examples of previously patented devices designed for this purpose are disclosed in U.S. Pat. Nos. 429,894, 2,728,165, 2,994,356 and 3,310,091.

BRIEF DESCRIPTION OF THE INVENTION

The table cloth of the instant invention includes opposite side longitudinal marginal edge portions provided with hems and the opposite end portions of the hems have weight members enclosed therein. In this manner, the weight members serve to assist in retaining the table cloth in position over a table against displacement to the table by contact and against the longitudinal marginal edge portions of the table cloth which depend downwardly from corresponding marginal edge portions of the table from being blown upwardly by wind in the event the table cloth is used outside.

The main object of this invention is to provide a table cloth constructed in a manner whereby sufficient weight will be added to the depending marginal edge portions of the cloth to insure that the cloth will remain properly draped over a table.

Another object of this invention, in accordance with the immediately preceding object, is to provide a table cloth including marginal portions thereof equipped with hems and with weight members secured within the hems.

Yet another object of this invention is to provide a table cloth in accordance with the preceding object and whose weight members comprise flexible closed ended tubular members having fluent weight material disposed therein.

A final object of this invention to be specifically enumerated herein is to provide a table cloth in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
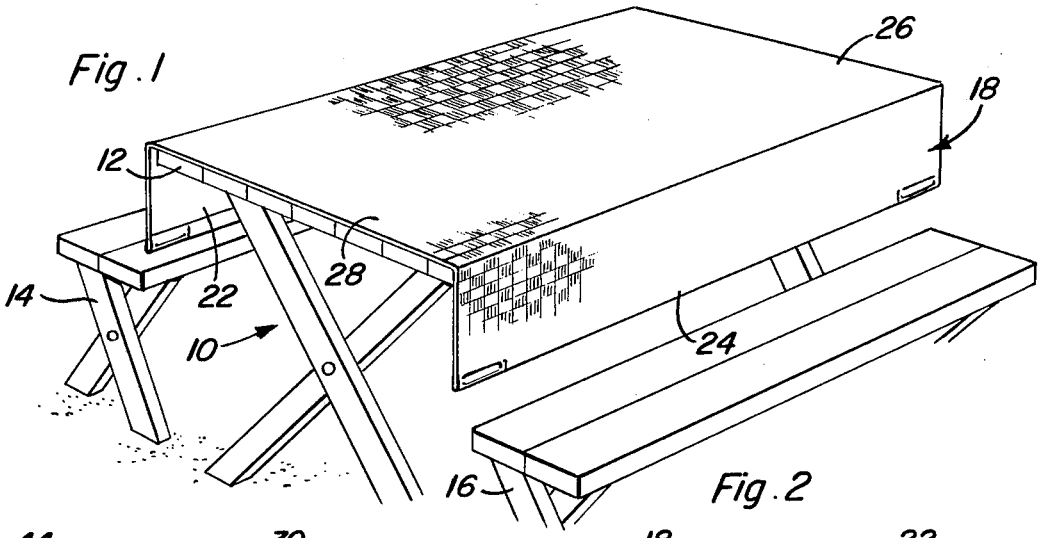
FIG. 1 is a perspective view of a picnic table having a table cloth constructed in accordance with the present invention draped thereover.
Figure 2:
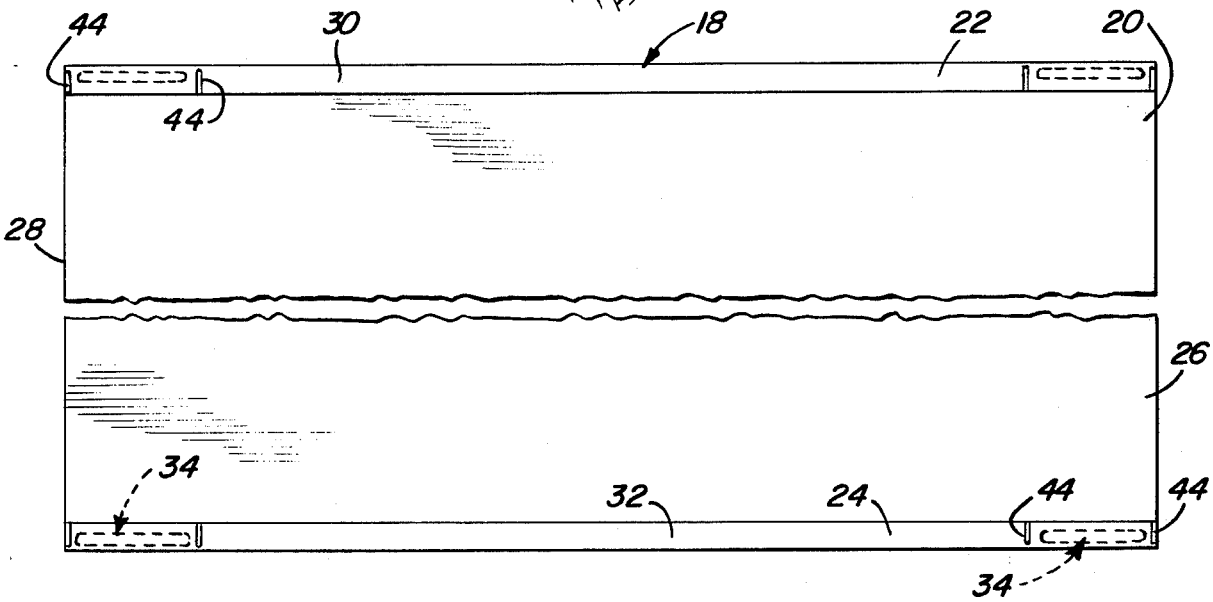
FIG. 2 is a fragmentary plan view of the table cloth.
Figure 3:
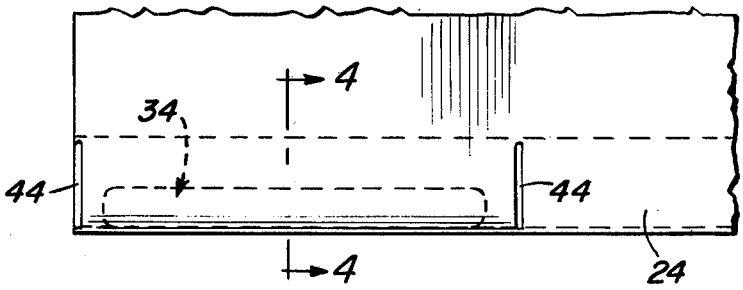
FIG. 3 is an enlarged fragmentary plan view of one corner portion of the table cloth.
Figure 4:
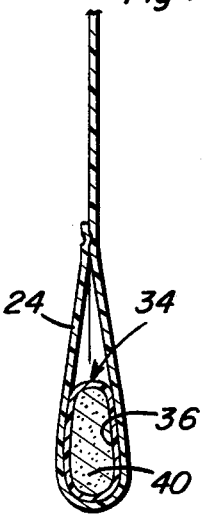
FIG. 4 is an enlarged fragmentary sectional view taken substantially upon the plane indicated by the section line 4—4 of FIG. 3.
Figure 5:
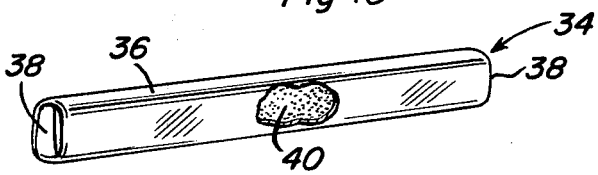
FIG. 5 is an enlarged perspective view of one of the weight members of the instant invention with a portion of the flexible cover thereof being broken away and illustrated in section.

Referring now more specifically to the drawings, the numeral 10 generally designates a conventional form of picnic table having a generally rectangular horizontal top 12 and with which a pair of benches 14 and 16 are operatively associated.

The table cloth of the instant invention is referred to in general by the reference numeral 18 and comprises a flexible panel 20 which is generally rectangular in plan shape and includes opposite side longitudinal marginal edge portions 22 and 24 and opposite end marginal edge portions at 26 and 28.

The marginal edge portions 22 and 24 include hems 30 and 32 and the opposite ends of each of the hems 30 and 32 have an elongated weight assembly referred to in general by the reference numeral 34 disposed therein.

Each weight assembly comprises a tubular body 36 of flexible material closed at its opposite ends as at 38 and having a fluent weight material 40 disposed therein.

The panel 20 may be constructed of any suitable material. The hems 30 and 32 may be formed by sewing, or if the panel 20 is constructed of plastic material the hems 30 and 32 may be formed by thermowelding.

The weight assemblies 34 are telescoped into the opposite ends of the hems 30 and 32 and the hems 30 and 32 are closed on opposite sides of each weight assembly 34 as at 44 either by sewing, gluing or thermowelding.

In operation, the table cloth 18 is draped over the tabletop 12 in the manner illustrated in FIG. 1 of the drawings with the opposite side longitudinal marginal edge portions of the panel 20 depending downwardly from the longitudinal marginal edge portions of the top 12. After the table cloth 18 has been stretched over the tabletop 12 in the manner illustrated in FIG. 1, the weight assemblies 34 will not only serve to hold down the opposite end portions of the longitudinal marginal edge portions 22 and 24 but also the opposite ends of the end marginal portions 26 and 28.

With the table cloth 18 draped over the tabletop 12 in the manner illustrated in FIG. 1, contact with the table cloth 18 by a person moving downwardly along either side of the table 12 and tending to displace the table cloth 18 will be resisted by the weight assemblies 34 on that side of the tabletop 12. In addition, the weight assemblies 34 will greatly facilitate the longitudinal marginal edge portions 22 and 24 of the panel 12 from being lifted by wind.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A table cloth for use over an elongated generally rectangular table top, said cloth comprising a rectangular flexible panel including opposite side and end marginal edge portions, said side marginal edge portions each including weight members supported from the opposite ends thereof, whereby said marginal edge portions, when hanging downwardly from corresponding edge portions of a table over which said panel is draped, will resist shifting of said panel relative to said table and lifting of said marginal portions of said panel from which said weight members are supported, said side marginal edge portions of said panel from which said weight members are supported including elongated hem portions extending longitudinally thereof, said weight members being enclosed within the opposite ends of said hem portions, said weight members comprising closed ended elongated flexible tubular members having heavy fluent material enclosed therein and extending longitudinally of the corresponding hem portion, said hem portions being closed on opposite sides of each of said weight members, each of said hem portions being free of weight members intermediate the weight members disposed in the opposite ends thereof.

* * * * *